US007610012B2

(12) United States Patent
Jones (Jabari)

(10) Patent No.: US 7,610,012 B2
(45) Date of Patent: Oct. 27, 2009

(54) RADIO VISION ELECTRONIC NETWORK/ANALOG OUTPUT/VIEWING SYSTEM

(76) Inventor: Keith Jones (Jabari), 1614 W. Jon Quil Ter., Chicago, IL (US) 60626

( * ) Notice: Subject to any disclaimer, the term of this patent is extended or adjusted under 35 U.S.C. 154(b) by 159 days.

(21) Appl. No.: 10/823,912

(22) Filed: Apr. 14, 2004

(65) Prior Publication Data

US 2005/0195337 A1 Sep. 8, 2005

(51) Int. Cl.
*H04H 7/00* (2006.01)

(52) U.S. Cl. ..... 455/3.06; 455/3.02; 455/556.1; 455/142; 348/729

(58) Field of Classification Search ..... 455/3.02, 455/3.06, 93, 353, 352, 426.1, 131, 154.1, 455/160.1, 161, 3.01, 30.6, 1, 556.1, 142; 348/729, 731, 473, 515; 725/98, 87
See application file for complete search history.

(56) References Cited

U.S. PATENT DOCUMENTS 3,873,771 A * 3/1975 Kleinerman et al. ..... 370/204
4,057,836 A * 11/1977 Munsey ..... 348/22
4,196,447 A * 4/1980 Dalke ..... 348/32
4,516,151 A * 5/1985 Stahler ..... 348/23
4,651,195 A * 3/1987 Stahler ..... 348/491
4,715,059 A * 12/1987 Cooper-Hart et al. .... 348/14.14
5,568,185 A * 10/1996 Yoshikazu ..... 348/22
2003/0070174 A1 * 4/2003 Solomon ..... 725/98
2003/0179317 A1 * 9/2003 Sigworth ..... 348/515
2004/0136547 A1 * 7/2004 Anderson et al. ..... 381/102
2005/0018088 A1 * 1/2005 Bhat ..... 348/729
2006/0229046 A1 * 10/2006 Bult et al. ..... 455/252.1

* cited by examiner

*Primary Examiner*—Tan Trinh

(57) ABSTRACT

A system for AM broadcasting, and listing to audio, as well as, viewing slow scan pictures, by using an ordinary AM receiver and a slow scan video converter. The slow scan can be an AM picture, such as, robot 36, or a FM picture in the AM band, using the FAST FM MODE of a slow scan converter, like the KENWOOD VC-H1. A transmitter, like the AM-88 NORTH COUNTRY RADIO, can broadcast in AM or FM mode on the AM band.

Figure 1:
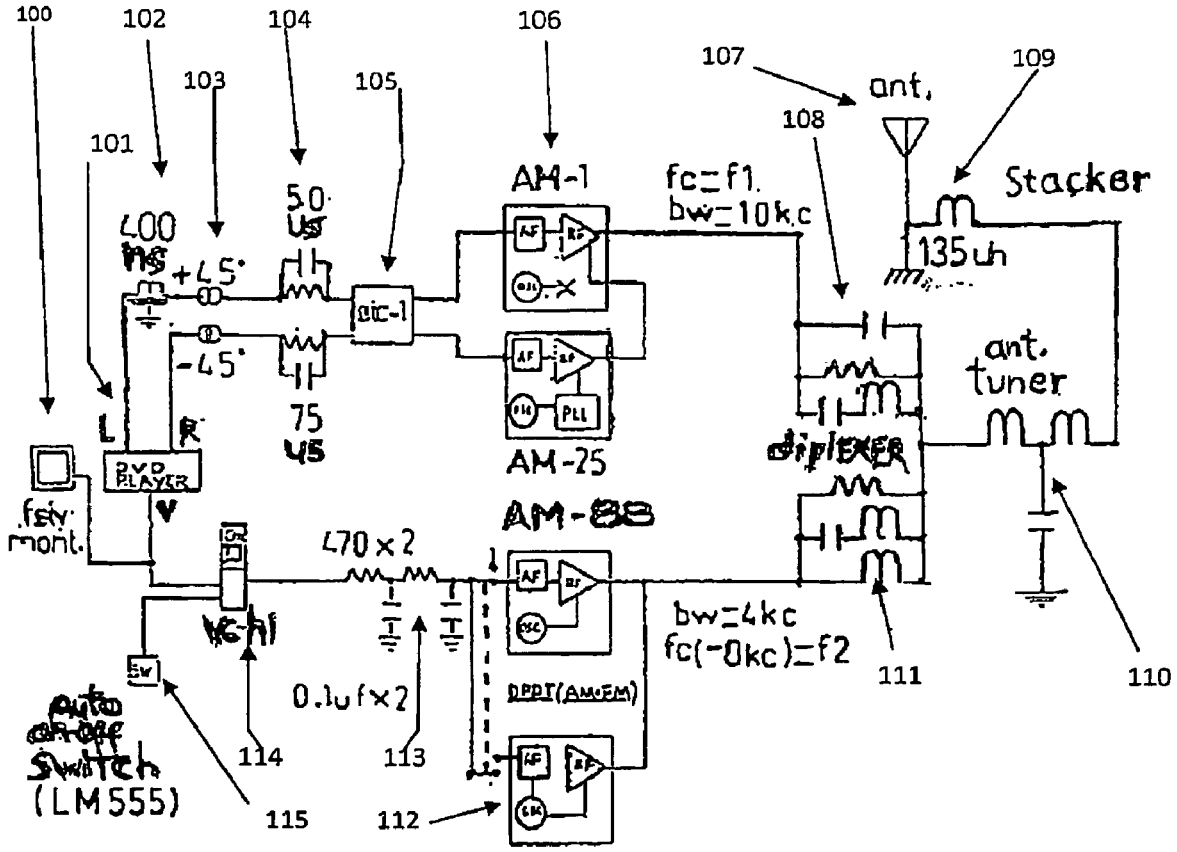
Figure 2:
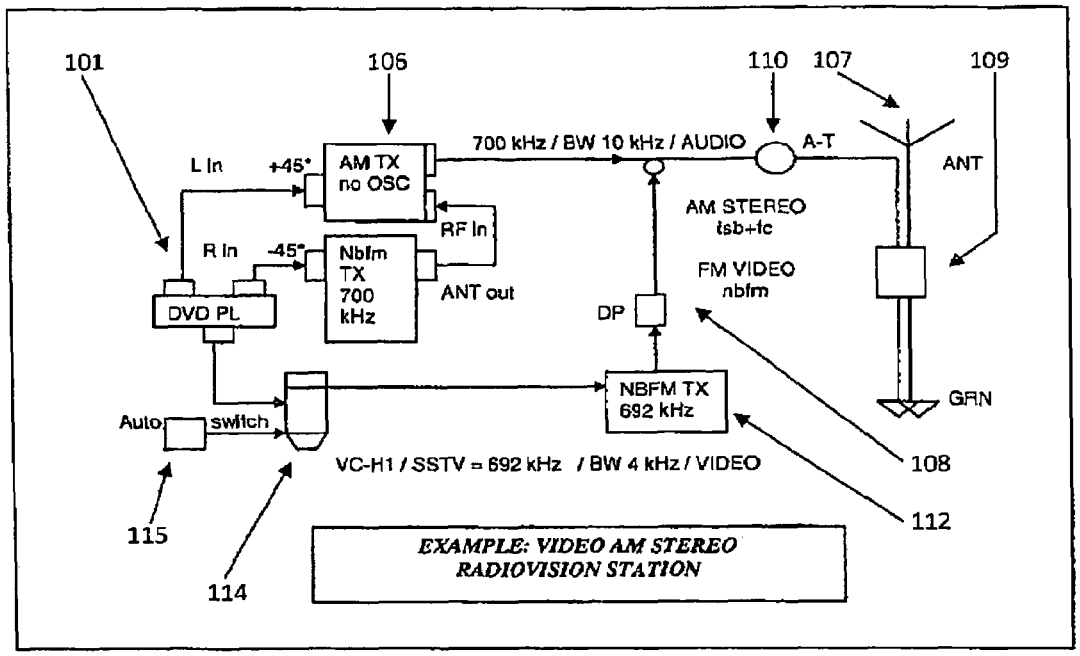

Because of frequency differences between the audio and video, and if desired, modulation differences between the audio and video, there is no interference between the audio and video on the AM service.

A diplexer and an antenna tuner enable both signals to be sent out from the same antenna.

1 Claim, 11 Drawing Sheets

Phase Network

RADIO VISION ELECTRONIC NETWORK/ANALOG OUTPUT/VIEWING SYSTEM

BACKGROUND OF THE INVENTION

Using two double sideband full carrier, AM transmitters, to produce AM stereo and one other transmitter either AM or NBFM in the AM band to produce the slow scan video on the AM band, 8 kHz down from the main audio carrier, and with the use of a diplexer, an antenna tuner and also antenna stacker, earth grounded, there is good separation of the AM station's audio and video within a 15 kHz bandwidth.

Single sideband suppress carrier will work well for the slow scan video also, but like NBFM, one would need special receivers for those two modulations.

Using NBFM in the AM band will enable the VC-H1 to use the FAST FM mode; the fax like beeps will be very faint over the AM receiver if tuned to the video frequency.

FIG. 8

602 VIDEO SWITCH BOX switches video over the air between VCR, DVD, and CAMERA.

801 LAPTOP COMPUTER for storage and playback of broadcast art.

FIG. 9

901 ANTENNA
902 RF AMPLIFIER
903 MIXER 1
904 AUDIO IF AMP. 455 kHz
905 AUDIO DETECTOR
906 AM stereo MATRIX
907 AUDIO DESCRIMINATOR
908 LEFT AUDIO AMP@+45*
909 RIGHT AUDIO AMP@−45*
910 DIAL TUNER
911 LOCAL OSCILLATOR. 455 kHz
912 PRESCALER
913 MIXER 2
914 VIDEO IF AMP. 455 kHz
915 VIDEO DESCRIMINATOR
916 LIMITER
917 VIDEO AF AMP
918 SLOW SCAN COLOR TV CONVERTER
919 DELAY LINE

FIG. 10

1001 The Kenwood VC-H1 wiring guide.

1002 Wiring set up for the RAVEN video am stereo transmitter.

This AM video system is different from Mr. Kahn's AM AUDIO/DATA SYSTEM because the data is embedded in the audio.

SSTV will not mix with audio, that is why there is a frequency difference in the RAVEN SYSTEM, and also the FCC does not consider SSTV picture information as data.

The auto switch LM555 timing circuit (designed and built by this inventor) enables the transmitter to broadcast one to two pictures per minute.

SUMMARY OF THE INVENTION

Present invention enables the Audio and SLOW SCAN TV signals to be transmitted over the same 15 kHz wide channel on the AM band. FOR EXAMPLE: 690 kHz to 705 kHz in which the Video Carrier is at 692 kHz@BW of 4 kHz (690 kHz to 694 kHz) and the Audio Carrier is at 700 kHz@BW of 10 kHz (695 kHz to 705 kHz); END OF EXAMPLE. *PLEASE NOTE 15 kHz wide at 700 kHz can also mean 692.5 kHz to 707.5 kHz. An update to the PREVIOUS EXAMPLE MENTIONED is: the Video Carrier could just as easily be put at, 708 kHz (8 kHz above the Main Audio Carrier), END OF THIS EXAMPLE.

AN ANOTHER EXAMPLE for the Video Carrier would be: an analog AM receiver with an analog tuner can be directly tuned to 692 kHz. But for an analog AM receiver with a digital tuner, the receiver would be tuned to 690 kHz for the Video, which would be, 10 kHz down from the Main Audio Carrier on that AM receiver. But if the Video is 8 kHz above the Audio Carrier, then the digital tuner would be tuned 10 kHz above@710 kHz in this Example. We can start by listening for the fax like beeps, before plugging in a Slow Scan Converter into the headphone jack of the AM receiver, being used for the Video. The same analog AM receiver used to receive the Video can tune in the Audio when tuned to 700 kHz; END OF EXAMPLE.

A Walkman style RCA AM/FM stereo cassette player #RP-1872C was used to check the on air frequencies, also used was a radio shack DMM 22-174B set for Hz kHz and a GW-INSTEK Digital Frequency Counter #GCF-8010H to check the frequency.

All transmitters used are hobby broadcast equipment and are of the name brands: RAMSEY; and NORTH COUNTRY RADIO.

Three receivers were used; two for receiving the stereo in the same manner used for receiving the Kahn AM Stereo System, Except in the case of THE RAVEN, The right channel receiver is tuned right on the audio carrier frequency, due to the phase lock loop of the AM 25 transmitter, the left channel receiver is tuned slightly off to the left of the audio carrier frequency.

Now the third AM receiver needs the used of a Slow Scan Converter like the KENWOOD VC-H1, Such as the one used at the transmitter site, the only difference being the VC-H1 at the transmitter site, is in the AUTO TRANSMIT (once very three minutes) MODE, which is too slow for commercial broadcast use. A 555 timing circuit was built to cause the AUTO TRANSMIT MODE to transmit a new picture every minute, also with *LIVE ACTION CAPTURE* built in by KENWOOD, there is no need to stop the action or pose, to send a new picture, furthermore the VC-H1 at the transmitter site will not receive, when it is in the AUTO TRANSMIT MODE, therefore, there will be no video interference from other radio stations using the same system.

BRIEF DESCRIPTION OF THE DRAWINGS AND THE PREFERRED EMBODIMENTS

FIG. 1

100. Color TV monitor.
101. DVD player.
102. Delay line 400 nano second to left channel.
103. Leftand right channel 45 degree out of phase networks.
104. Optional pre-emphasis.
105. Stereo limiter.
106. AM stereo transmitter.
107. Antenna.
108 and 111 RF signal combiner called a diplexer.
109. Stacker increases the electrical leant of the antenna.
110. Antenna Tuner.
112. Video transmitter.
113. De-emphasis input.
114. Slow Scan TV converter.
115. Auto switch to SSTV converter.

FIG. 2

Figure 3:
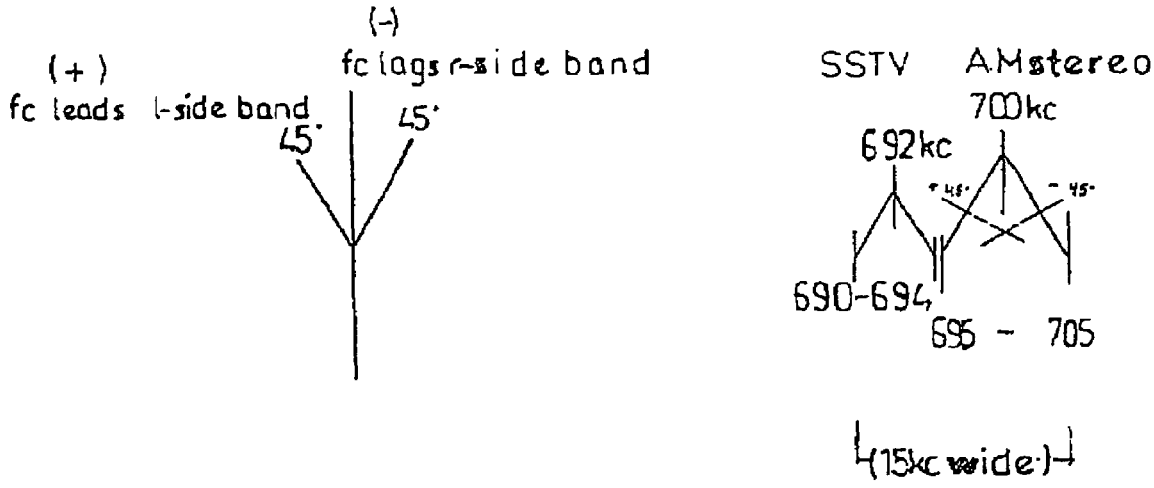
Figure 4:
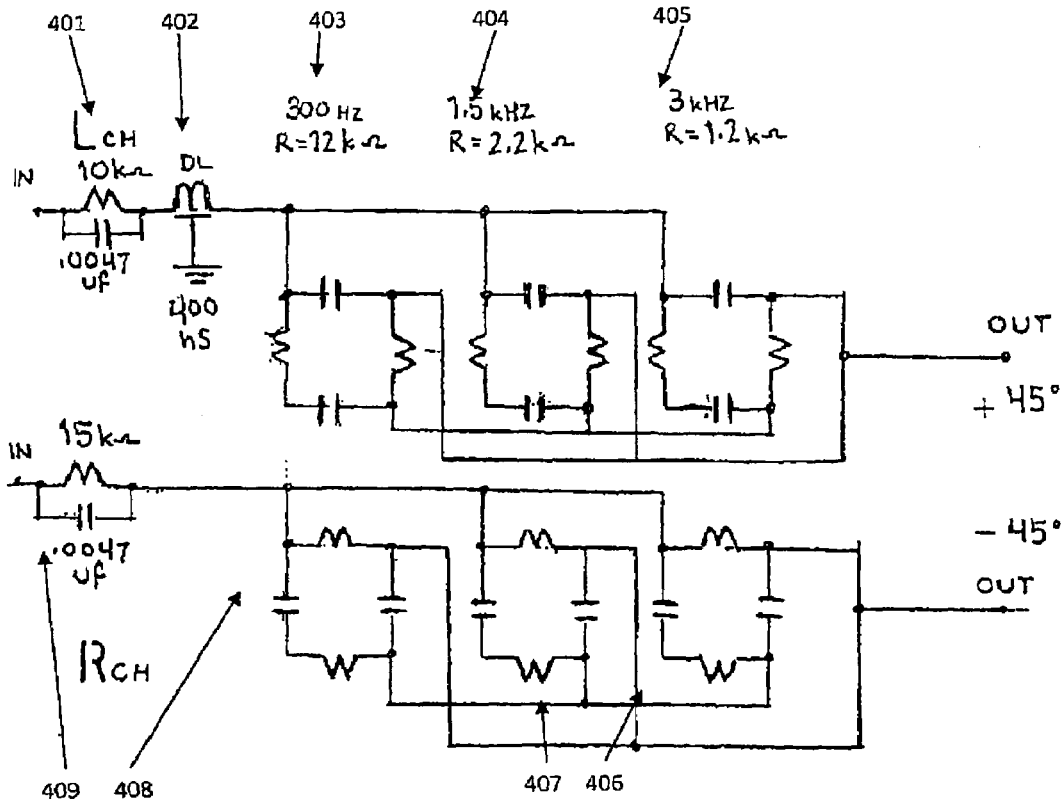
Figure 5:
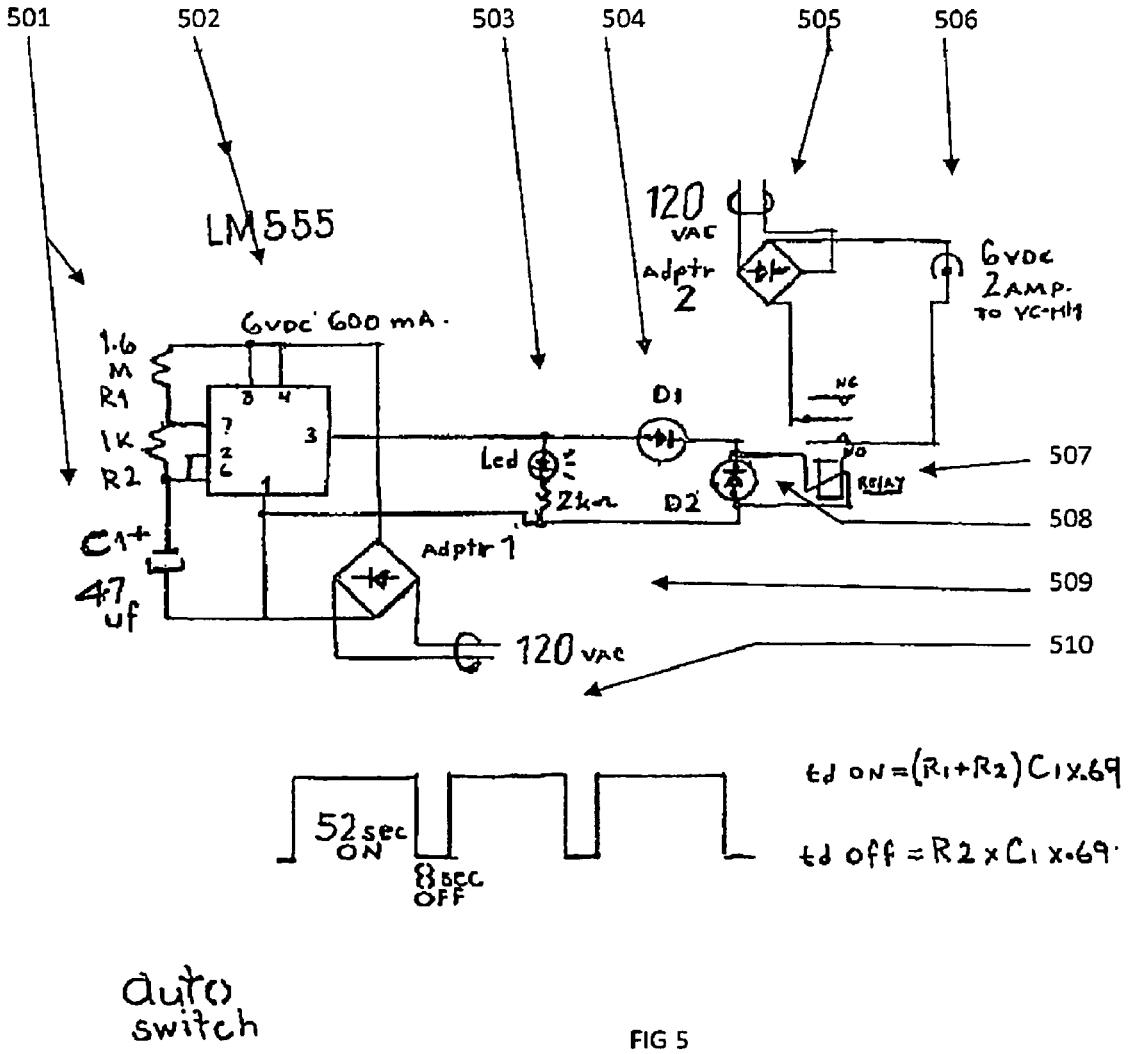
Figure 6:
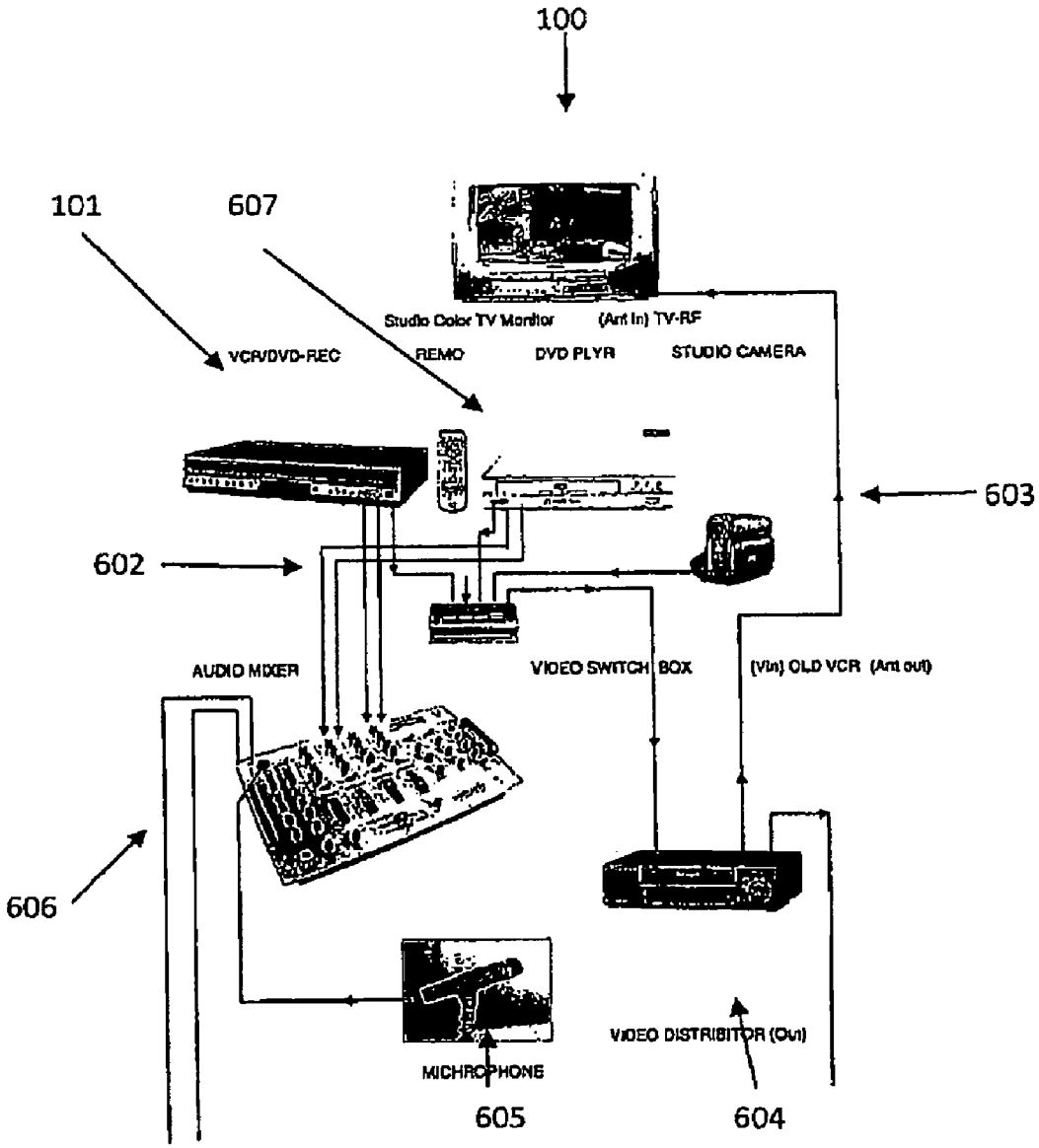
Figure 7:
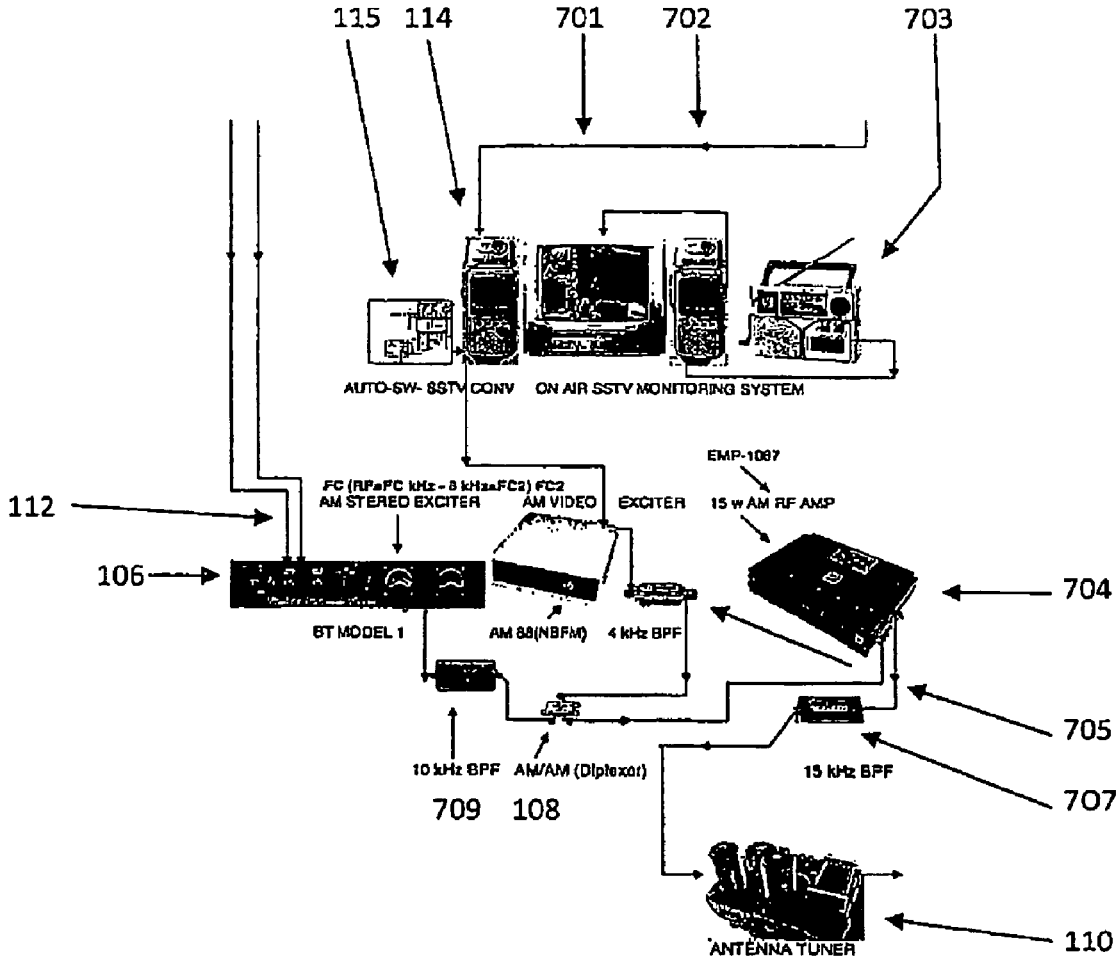
Figure 8:
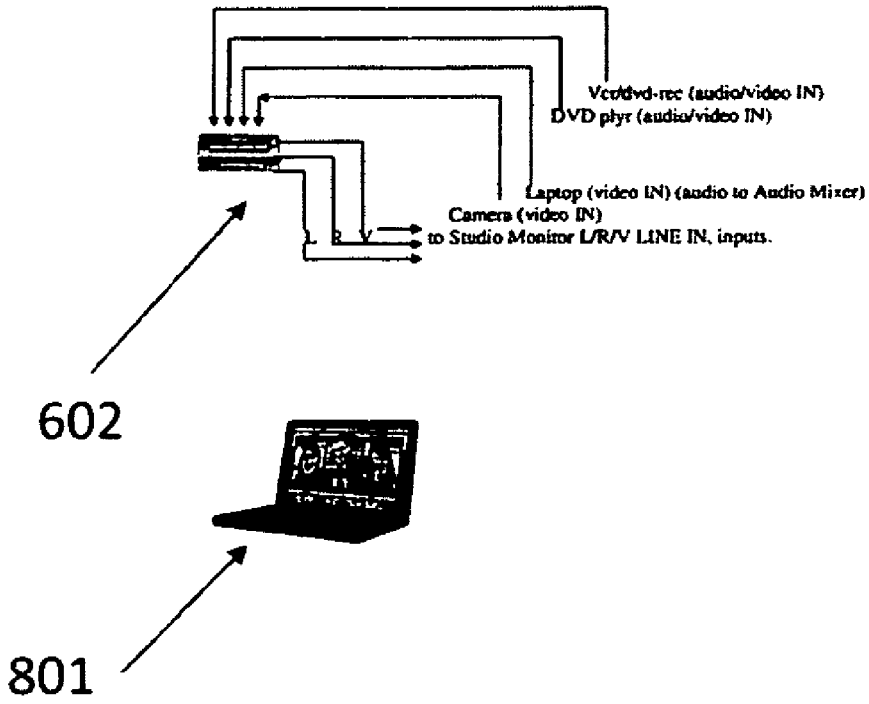
Figure 9:
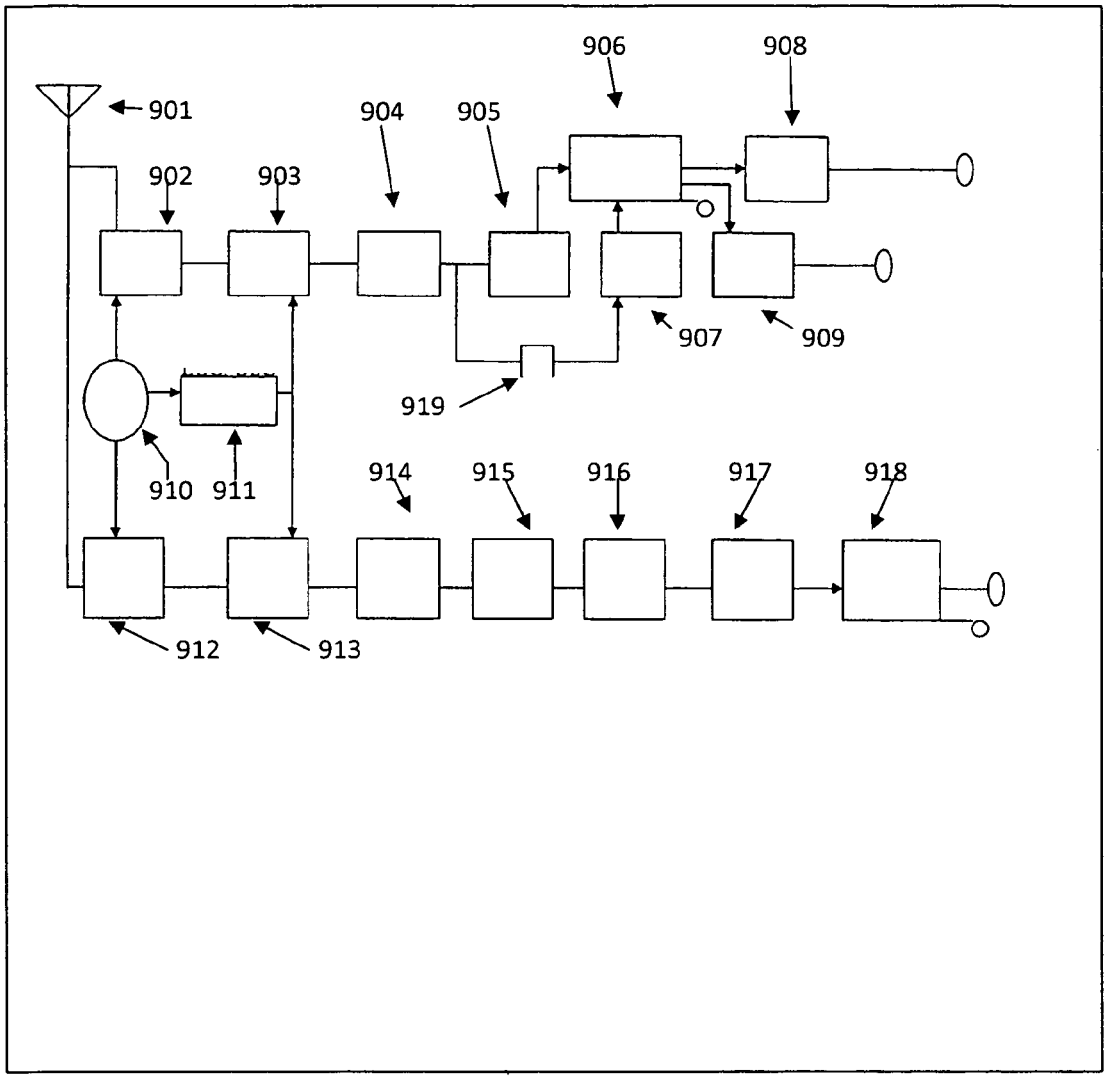
Figure 10:
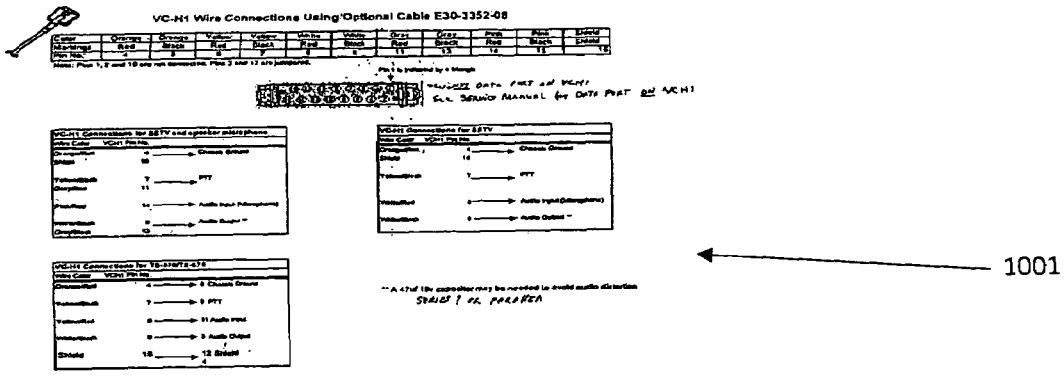
Figure 10:
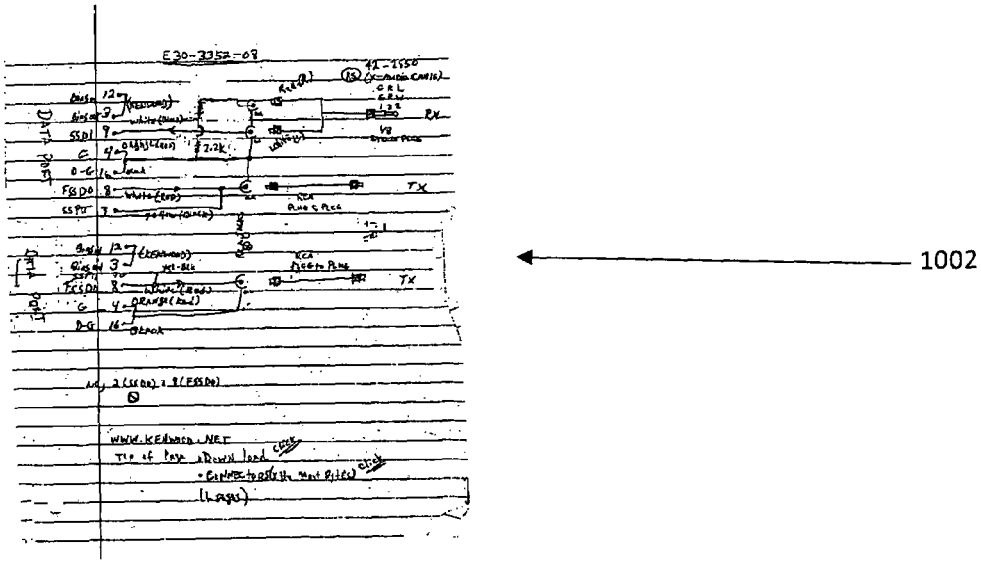
Figure 11:
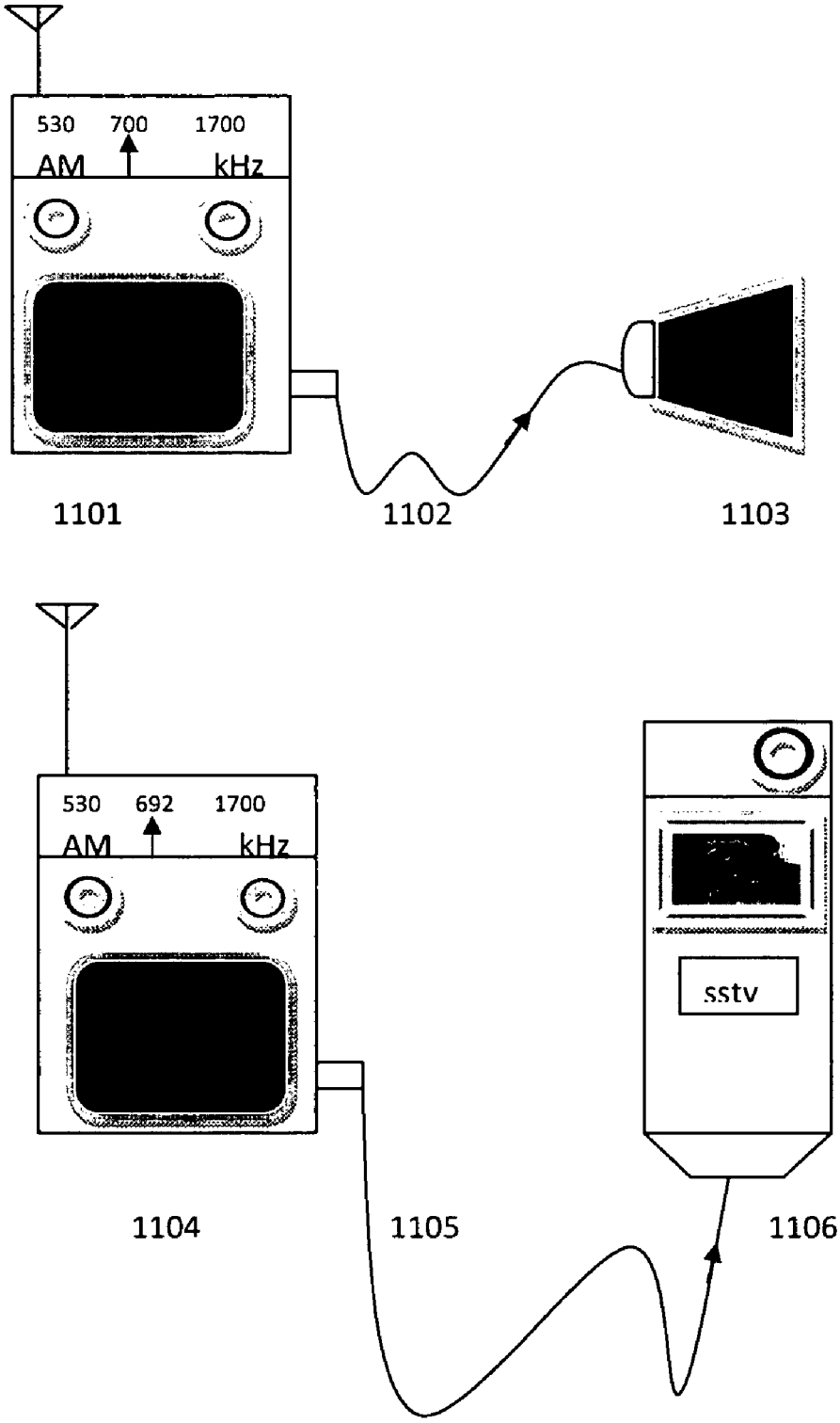

101. DVD Player.
106. AM Stereo Transmitter.
107. Antenna.
108. Diplexer.
109. Stacker.
110. Antenna tuner.
112. Video transmitter.
114. SSTV converter.
115. SSTV auto switch.
FIG. 3
A. The channel bandwidth of an AM radio station at 700 KHz.
B-1. The audio portion of this station.
B.-2. The AM stereo vectors of B-1.
C. The video portion of the AM radio station at 700 kHz
FIG. 4
401 and 409=the optional per-emphasis input networks.
402=Delay line.
403 and 408=300 Hz audio section.
404 and 407=the 1.5 kHz audio section.
405 and 406=the 3 kHz audio section
C=--//--=12 CAPASITORS with a value of 0.047 microfarads.
R=--ww--=12 RESISTORS
4 RESISTORS at 12 kilo ohms (12,000) for the 403-408 section.
4 RESISTORS at 2.2 k ohms for the 404-407 section
4 RESISTORS at 1.2 k ohms for the 405-406 section
FIG. 5
501=RC on/off timing circuit
502=IC (LM 555 timer)
503=Power on (red LED), 117 to 120 volts AC
504=6 volts/2 amps on (green LED)
505 and 509=AC to DC voltage adaptors
506=6 volt 2 amp output
507=10 volt DC relay
508 relay damper diode
510=6 volts/2 amps pulse DC, 52 seconds ON, 8 second OFF at output 506
FIG. 6
color video camera.
604=video distributor (VCR).
605 audio microphone.
606. Audio control console
FIG. 7
106. AM Stereo exciter.
108. Diplexer.
110. Antenna tuner.
112 Video exciter.
114. SSTV Converter-TX.
115. SSTV auto switch.
701. On air color video monitor.
702. SSTV Converter-RX.
703. Standard radio receiver.
704. RF amp (AM transmitter).
705-707-709, Bandwidth filters.
FIG. 11
1101. AM receiver.
1102. earphone jack and cable.
1103. audio speaker.
1104. AM receiver.
1105. earphone jack and cable.
1106. Slow scan TV converter Receiving an image from the AM RECEIVER.

An AM-88 transmitter can be used to transmit AM pictures, as well as FM pictures in the AM band.

THE RAVEN
RECOMMENDED POWER LEVELS FOR AM/AM STEREO AND MINUTE-BY-MINUTE STILL LIFE PICTURES COMMERCIAL BROADCAST U.S. AM RADIO STATIONS

| AUDIO | VIDEO |
|---|---|
| NATIONAL /REGONAL | |
| 50 kw | 5 kw |
| 25 kw | |
| 10 kw | |
| REGONAL/LOCAL | |
| 5 kw | 1 kw |
| 2.5 kw | |
| 1 kw | |
| LOCAL/COMMUNITY | |
| 500 w | 100 w |
| 250 w | |
| 100 w | |
| Low Power AM Part - 73 | |
| 99 w | |
| 50 w | |
| 35 w | 10 w |
| 25 w | |
| 10 w | |
| 5 w | |
| 2 w | |
| Hobby Broadcast AM Part - 15 | |
| 1 w | |
| .75 w | 1 w |
| .25 w | |

The video power recommendations are for, AM pictures. Antenna height should be considered for FM pictures, such as; if the antenna height is 1160 feet then the maximum video power would be any where from 3 kW to 6 kW, for commercial broadcasting.

OTHER REFERENCES

Magazine Article by Harry Maynard/AM Stereo It's Time Has Come; October 1976.

McGraw-Hill Books/Electronic Communications: PP. 63 AND 92; Louis E. Frenzel: Third Edition.

Tab Books/The Complete Handbook of Slow Scan TV by Dave Ingram

Radio Shack 2002 Catalog: A Brief Description of RDS (FM Radio Data Service).

INTERNET: Slow Scan TV History 1970 W7FEN: Single Sideband-Suppress Carrier; Lower Sideband Audio; Upper Sideband Video.

INTERNET: Commercial AM Transmitters; Articles on Power Side and CAM D. Kahn Communications (No Schematics)

INTERNET: Advertisement; Low Power AM Part-73; AM-30P, AM-60P and AM-100P: LPB, Inc.

Hobby Broadcast Manuals (Part-15)/AM-1; and AM PRO-25; Ramsey Electronics.

Tab Books/AM Stereo & TV Stereo—New Sound Dimensions; Stan Prentiss.

Magazine Article by Michael Banks/Just the (Radio) Fax November 2003, Nuts and Bolts.

Hobby Broadcast Manual (Part-15)/AM-88: North Country Radio

Magazine Article by Alex K./AM Stereo: What Happened? March 2000, Hobby Broadcasting.

The invention claimed is:

1. A method for broadcasting audio and slow scan TV signals simultaneously from the same AM broadcast station, comprising: AM broadcast station is transmitting the audio and slow scan TV signals at the same time over the air, wherein the audio and slow scan TV signals to be transmitted over the same 15 KHz Wide channel on the AM band within the bandwidth that is allowed by the Federal Communication Commission that regulates broadcast communications, wherein for AM Video an AM Analog Radio with an Analog tuner can be directly tuned to 692 KHz; An Analog Radio with Digital tuner can be tuned to 690 KHz for the video, which would be 10 KHz down from the main audio carrier on the AM receiver, and using any ordinary broadcast AM receiver by listening the Fax like Beeps, before plugging in any stand alone Slow Scan TV Converter in the Headphone jack of the AM receiver being used for the video, the same AM receiver used to receive the video, can tune in the audio when tuned to 700 kHz.

* * * * *